United States Patent [19]

Harth et al.

[11] Patent Number: 4,915,073

[45] Date of Patent: Apr. 10, 1990

[54] BOILER TUBE WALL INSPECTION SYSTEM

[76] Inventors: George H. Harth, 340 High Point, Wadsworth, Ohio 44281; Daniel M. Schlader, 117 Locksley Pl.; Robert E. Womack, Rte. 2, Box 908, both of Forest, Va. 24551

[21] Appl. No.: 358,988

[22] Filed: May 26, 1989

Related U.S. Application Data

[62] Division of Ser. No. 198,430, May 25, 1988, abandoned.

[51] Int. Cl.[4] ..... F22B 37/18; F22B 37/48

[52] U.S. Cl. ..... 122/379; 15/104.11; 165/11.2; 165/95

[58] Field of Search ..... 122/379, 390, 391, 392; 165/11.2, 95; 15/104.11

[56] References Cited

U.S. PATENT DOCUMENTS

| | | | |
|---|---|---|---|
| 3,196,088 | 7/1965 | Coleman et al. | 122/379 |
| 4,460,920 | 7/1984 | Weber et al. | 165/11.2 |
| 4,492,187 | 1/1985 | Hammond | 122/392 X |
| 4,675,728 | 6/1987 | Egger et al. | 358/100 |
| 4,718,376 | 1/1988 | Leroueil et al. | 122/379 X |
| 4,803,959 | 2/1989 | Sherrick et al. | 122/392 X |

*Primary Examiner*—Edward G. Favors

*Attorney, Agent, or Firm*—Daniel S. Kalka; Vytas R. Matas; Robert J. Edwards

[57] ABSTRACT

A remotely operable boiler tube wall cleaning and inspection system including a collapsible "H" frame capable of being inserted through the boiler manway access ports and being positioned at will over the full area of the tube wall.

5 Claims, 3 Drawing Sheets

BOILER TUBE WALL INSPECTION SYSTEM

This is a division of application Ser. No. 198,430, filed May 25, 1988, abandoned

BACKGROUND OF THE INVENTION

1. Field of the Invention

The present invention relates in general to a remotely positionable cleaning and inspection system. More particularly, it pertains to a modular wall crawler having a collapsible "H" shaped structure for boiler tube wall inspection and cleaning.

2. Description of the Related Art

The periodic inspection of internal tube walls in boilers has been accomplished traditionally by the use of personnel equipped with hand-held inspection devices. Access to these surfaces has been made possible by erecting appropriate scaffolding or the use of "sky climbers", "bosun's chairs", or similar devices to permit workers to position themselves properly in areas inaccessible by other means.

This approach is costly, time consuming, and hazardous to the personnel involved in the operation. Erection of the internal scaffolding or rigging for the other access modes mentioned cannot commence until the unit has cooled sufficiently to permit long-term entry by the personnel. The scaffold erection process and its subsequent removal involves personnel who should have no function in an inspection, and is thus an added expense throughout the outage.

U.S. Pat. No. 4,671,382 to D'Alessio, et al discloses such a scaffolding support assembly particularly useful as a base for modularized post-and-runner type scaffolding used on the interior of boilers or similar large interior spaces having sloping bottom walls for inspection, repair, maintenance, etc. The vertical uprights in the scaffold latticework have swivel bases, preferably of standard construction modified to accept stabilizing diagonals for tying into the balance of the scaffold latticework. The foot of the scaffold post rests, without attachments thereto, on a sloping surface, and is tied rigidly to a point on an adjacent scaffold post, thus securing the foot in position.

The height at which most of the tube inspection is done presents a significant personnel hazard. The environment in which it is done, particularly during the wall cleaning phase preparatory to the actual tube inspection efforts, is dirty and undesirable enough to prevent a team of skilled inspection technicians from functioning at top efficiency and productivity. Significant equipment is required to protect them from inhalation of damaging quantities of the materials dislodged from the tube walls.

A way to avoid the undesirable aspects of this work without appreciably increasing the cost of the inspection is needed.

U.S. Pat. No. 4,653,409 to Eriksson discloses an apparatus for regulating and cleaning air passages provided in the side wall of the furnace. The apparatus comprises a sleeve member reciprocatably mounted in the inner blocks and insertable into the air passage. The rear opening of the sleeve member connects to and is supported by a hollow section of an elongate holder which is slidably mounted in the longitudinal direction and extends through the wall of the air box. A driving device permits the apparatus to "poke" when necessary by pushing forward from its regulating position such that the inner end extends into the furnace for keeping the air passages clean. Furthermore, the hollow section of the holder has at least one air inlet which is substantially closed in its original position to prevent the admission of air into the air inlet. When the sleeve member is in the second or advanced position; the air inlet is outside the housing member to allow air from the air box to flow through the air inlet into the sleeve member.

This device is large and requires it to be fixed in one area of the furnace. It lacks the portability needed in boiler tube walls.

U.S. Pat. No. 4,241,609 to Bergman, et al discloses an internal measuring instrument for measuring the wall thickness of pipes and tubes which contain bends and curvatures along their length. The device also provides for detecting flaws within the tubes by using ultrasonic pulse/echo transducers. This internal inspection device requires access to the inner surface of the tube. Such a requirement would meet strong opposition in the power industry, especially for boiler waterwall tubes. Access to waterwall tubes is achieved through tube cutting or through water wall header inspection ports which are welded into place. The device comprises a rotatable disc support smaller in diameter than the interior diameter of the tube, wherein the disc is adapted to be snaked through the length of the tube.

Even though this apparatus is portable and requires a minimum of personnel, it lacks the flexibility of being able to function effectively in large areas as well as smaller ones. Also, it does not provide for cleaning the boiler tubes prior to or simultaneously with the inspection.

Therefore, there is a need for a remotely operable boiler tube wall cleaning and inspection system capable of being inserted through the boiler manway access ports and being positioned at will over the full area of the tube wall.

SUMMARY OF THE INVENTION

The present invention solves the aforementioned problems with a remotely positionable cleaning and inspection system, capable of being inserted through the boiler manway access ports and positioned at will over the full area of the tube wall to perform cleaning and/or inspection functions.

No personnel entry into the boiler interior other than momentary entry during the insertion of the equipment and its removal is anticipated. The present invention described herein essentially removes all workers from the tube wall area. In this way, it should significantly reduce inspection costs and the associated risks to personnel.

Accordingly, one aspect of the present invention is directed toward keeping workers clear of the heat, height, and respiratory hazards normally associated with this type of work.

Another aspect of the present invention is to improve the quality of the inspection data, since the working environment available to the inspection team is infinitely more comfortable, thus allowing concentration on the task rather than personal discomfort.

A further aspect for the present invention is that a considerable period normally assigned to cool-down of the unit before any preparatory work is no longer needed and this time can now be used in the actual set-up of this equipment and the time saving utilized in the inspection and cleaning.

Still a further aspect of the present invention is that the data acquisition rates of this system generate further reduction in manpower and outage time.

The present invention discloses a system comprising conventional non-destructive testing transducers, cameras and their associated illumination, and tube cleaning mechanisms, all attached to a remotely actuated and positionable carriage, and the position mechanism necessary to move the carriage over the entire surface of the tube wall. This particular device may be remotely selected and actuated from outside the boiler by the operator. The carriage position, and therefore the position of the chosen device, may be varied by the operator while the progress of the operation is monitored visually or by other means.

DESCRIPTION OF THE PREFERRED EMBODIMENT

Figure 1:
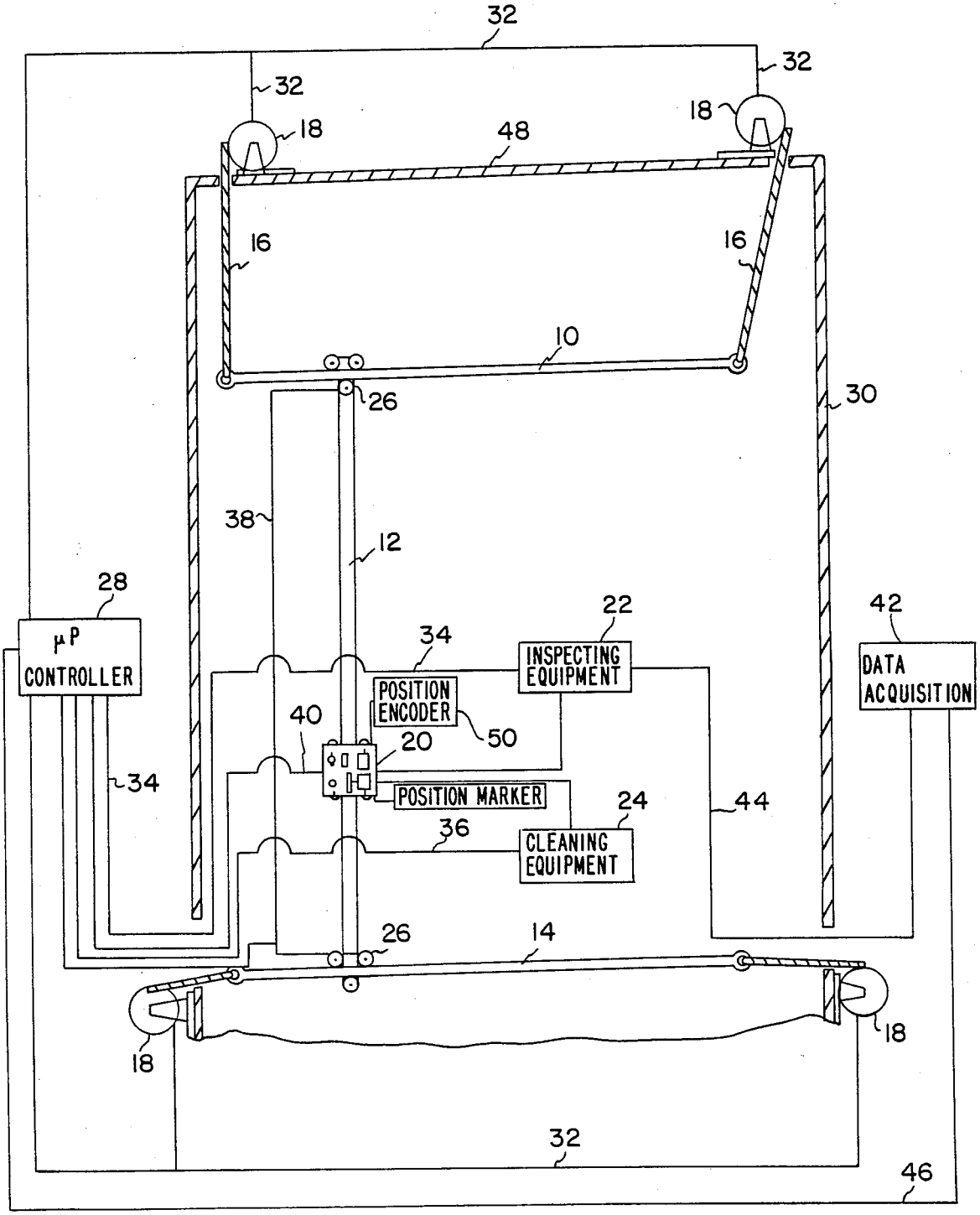
FIG. 1 is a cross-sectional view of the preferred embodiment of the present invention in place on a boiler furnace tube wall.

Referring now to the drawings, in which like reference characters designate like or corresponding parts throughout the several views, in FIG. 1, there is shown the preferred embodiment of the present invention in position on a boiler tube wall. The upper rail 10 and the lower rail 14 are arranged parallel to each other with the middle rail 12 situated transversely therebetween. The upper and lower parallel rails 10, 14 are positioned and stabilized by a set of tension cables 16 extending out through access openings in the external shell of the boiler tube wall 30 with the aid of winches 18. From FIG. 1, it is readily apparent that cables 16 may be tightened either manually or with the use of electric winches which are controlled by a microprocessor controller 28 via transmission control lines 32.

The "cross-bar" of the "H" or middle rail 12 is positioned vertically between the upper rail 10 and lower rail 14, and serves as a track upon which a carriage 20 can move with conventional inspecting and/or cleaning equipment 22, 24 which are directed by the microprocessor controller 28 through transmission control lines 34, 36 respectively, which allow the equipment to be fully operable by remote control. The carriage 20 serves as an all-purpose delivery vehicle for the equipment needed for cleaning, inspecting, and verifying the condition of the furnace tube wall surface. Thus, it should be equipped to carry some or all of the following components: closed-circuit television camera, lighting sufficient to support the camera, inspection equipment such as an ultrasonic or electromagnetic acoustic transducer assembly, etc., rotary wire brushing equipment for cleaning, and blaster, etc., position encoders 50 (two and possibly three axis), and position marker systems 52 (paint or chalk). Whether all of these would be in place at all times depends on the particular situation. Probably the surface cleaning mechanism and the ultrasonic or electromagnetic assembly would not be carried at the same time.

A data acquisition system 42 receives signal outputs from the inspecting equipment 22 via signal output line 44. The signals received from the inspection equipment 22 can be video, ultrasonic, or electromagnetic signals. The generated data is sent to the control system 28 by means of transmission line 46 which is then made available to the operator.

The orientation of the middle rail 12 was chosen to minimize the mass of equipment 22, 24 which must be repositioned in the direction of cleaning and/or scanning. However, it is to be understood that other orientations of this invention are also operable. Since the boiler tubes are normally vertically oriented, scanning and/or cleaning will be predominantly vertical.

Only the carriage 20 carrying the conventional cleaning and/or inspecting equipment 24, 22 moves during a scan. Then, the middle rail 12 may be removed to one side into the next position by means of remotely controlled motor driven roller assemblies 26 which are controlled by the microprocessor controller 28 via transmission control lines 38.

Figure 2A:
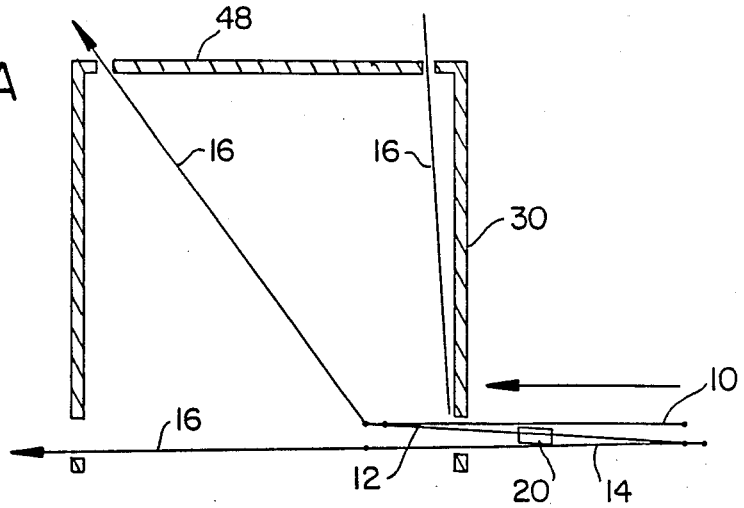
FIG. 2 (1–3) is a cross-sectional illustration of how the present invention is assembled and installed on a boiler tube wall.
Figure 2B:
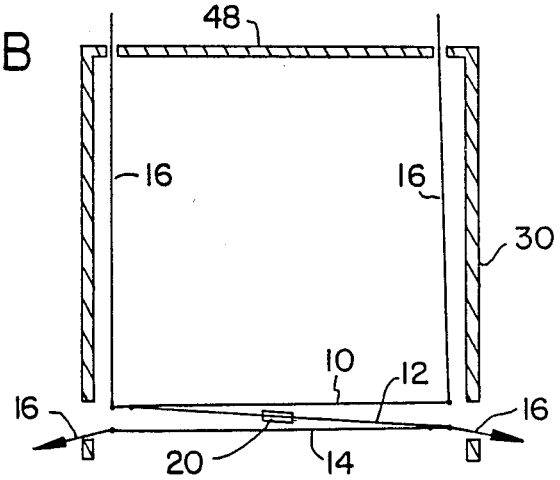
Figure 2C:
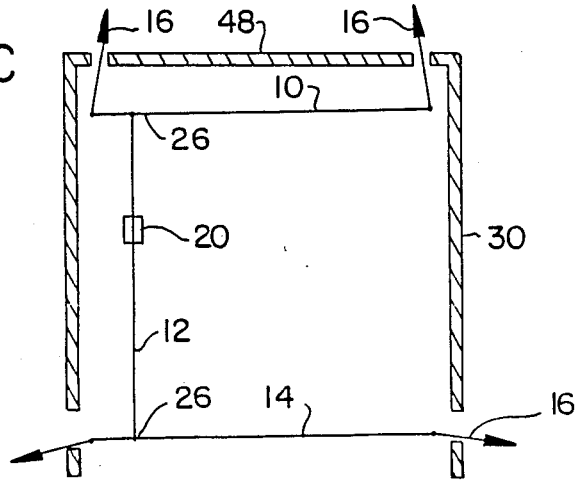

The motor driven roller assemblies 26 are provided with a braking asssembly which can hold or lock the middle rail 12 in place. The roller assemblies 26 are further provided to allow the three rails 10, 12, 14 to collapse into a "Z" shape resembling a consisting of three approximately parallel beams. In this fashion, it can be inserted as a unit horizontally through an access port near the bottom of the boiler tube wall 30. Cables 16 are lowered from the cable openings at the roof 48 of the boiler and attached to the end of the upper horizontal rail 10. The lower horizontal rail 14 is restrained in its position by tensioning cables 16 extending out from its ends through the lower access openings. Hoisting the upper rail 10 upward as far as it will go will automatically put the middle rail 12 in its proper position. This sequence is illustrated in FIG. 2.

The movement of the roller assembly 26 is motor driven, either by direct gear coupling, or by a friction wheel type drive. It may even be moved by a cable and pulley arrangement associated with each axis of movement. The carriage 20 is also motorized in at least two directions either by means of cable drive, friction wheel, or gear coupling between the middle rail 12 and the carriage 20 so that at least longitudinal and lateral motion are achieved. This bi-directional movement provides for complete accessibility of the tube wall for the cleaning and/or inspecting equipment 24, 22. The microprocessor controller 28 controls the carriage 20 by means of transmission control line 40.

The prime movers for the motion of the carriage 20 should be electrical stepping motors. These may either be mounted directly on the part to be moved and connected to the controller 28 outside by an electrical umbilical cord 40, or the motors may be mounted elsewhere and connected to the moving part by a linkage of mechanical cables and pulleys. The motion of the carriage 20 will be on a true X, Z coordinate system. The plane of the tube wall 30 may be distorted from service conditions such that it deviates the orientation of the scanning system. To compensate for this misalignment, the carriage 20 will have an internal movement capability in the two axes normal to the principal direction of carriage 20 motion. This will allow the device in use to follow bow and lateral offsets of the tubes.

Figure 3:
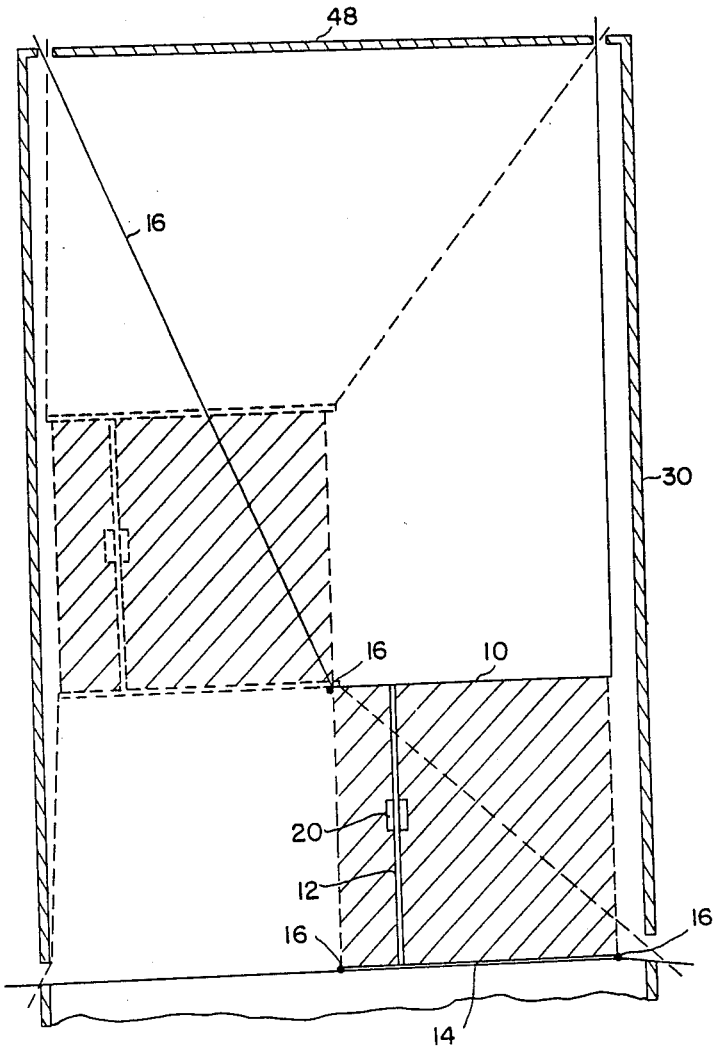
FIG. 3 is a cross-sectional illustration of how the present invention is utilized on a large furnace wall structure.

The widely varying dimensions of furnace walls in existing boilers do not permit one size system to serve them all. Ideally, the scanning system should cover the entire tube sheet without repositioning the frame; this is probably impossible in the largest units. The sequence illustrated in FIG. 3 shows how a system, when sized to do full coverage of the smallest unit to be serviced, can be repositioned to cover the larger unit with minimal disruption in schedule. The "H" structure is fixed in one position while the carriage 20 and the middle rail 12 cover the area limited by the length of the rails 10, 14; the entire structure is then moved to an adjacent area by means of a multiple windlass and cable arrangement 16, 18, or any suitable remote control means such as hydraulic lifters; and the motion of the carriage 20 and the middle rail 12 in that zone are resumed.

It is readily apparent that the length of the rails will be determined by the dimensions of conventional boiler tube walls, or particular applications. Likewise the rails 10, 12, 14 are made from material that is strong enough to support conventional cleaning and inspection equipment 24, 22 such as aluminum for example. It is further possible for the carriage 20 to be provided with a sub-carriage to facilitate its bi-directional movement.

The control and data acquisition systems 28, 42 for the operation will remain outside, providing better reliability for both the equipment and the operator. Conventional computers with microprocessor controls are suitable controlling means and with conventional adaptation are suitable data acquisition means. The location of the carriage and its sensors will be made continuously available to the operator by the foregoing. Data logging will be tied to system coordinates such that the operator may return to a given location of concern by simply punching coordinates into the controller.

The nature of the present invention makes slight modifications readily available. For example, it is possible that some form of electromagnetic or other remotely controlled clamping devices at each corner of the frame would supplement the windlass and cable arrangement. Likewise, it would be possible to add hinged supplementary frame stiffeners which connect the corner of the upper rail 10 and lower rail 14.

The availability of microelectronics, improved optical systems, and more efficient motors and position encoders, coupled with personal computers, provide a field of capabilities today that, because of the added mass of equipment alone, would have been impossible ten years ago.

While a specific embodiment of the present invention has been shown and described in detail to illustrate the application and principles of the invention, it will be understood that it is not intended that the present invention be limited thereto and that the invention may be embodied otherwise without departing from such principles.

We claim:

1. An apparatus for cleaning a boiler tube wall, comprising:

an upper rail;

a lower rail situated substantially parallel with said upper rail;

a middle rail pivotally attached to said upper end lower rails, said middle rail having a first collapsed position being situated immediately between and approximately parallel with said upper and lower rails for entry into a boiler tube, said middle rail further having a second expanded position being situated transversely between said upper and lower rails after entry in the boiler tube, said middle rail being situated in the second position between said upper and lower rails for movement lengthwise along said upper and lower rails;

a carriage moveably connected to said middle rail;

means for remotely controlling movement of said carriage;

means for cleaning the boiler tube wall connected to said carriage on said middle rail; and means for moving said rails within the boiler tube.

2. An apparatus for cleaning a boiler tube wall, as defined in claim 1, further comprising a position encoder system connected to said carriage for indicating position of said carriage.

3. An apparatus for cleaning a boiler tube wall, as defined in claim 1, further comprising means for maintaining said middle rail in the second position with respect to said upper and lower rails.

4. An apparatus for cleaning a boiler tube wall, as defined in claim 1, wherein said moving means includes a motor driven roller assembly pivotally attached at each end of said middle rail to said upper and lower rails for moving said middle rail longitudinally along said upper and lower rails.

5. An apparatus for cleaning a boiler tube wall, as defined in claim 1, wherein said moving means further includes a multiple windlass and cable arrangement situated on the boiler tube wall having cables attached to each end of said upper and lower rails for positioning and stabilizing said rails in the boiler tube.

* * * * *

UNITED STATES PATENT AND TRADEMARK OFFICE

CERTIFICATE OF CORRECTION

PATENT NO. : 4,915,073

DATED : Apr. 10, 1990

INVENTOR(S) : Harth et al.

It is certified that error appears in the above-identified patent and that said Letters Patent is hereby corrected as shown below:

ON TITLE PAGE: Item [73] should read as follows;

" The Babcock & Wilcox Company, New Orleans, Louisiana".

Signed and Sealed this

Thirty-first Day of December, 1991

*Attest:*

HARRY F. MANBECK, JR.

*Attesting Officer*

*Commissioner of Patents and Trademarks*